US009033743B2

(12) United States Patent
Kobayashi et al.

(10) Patent No.: US 9,033,743 B2
(45) Date of Patent: May 19, 2015

(54) ELECTRIC CONNECTION TERMINAL AND CONNECTOR INCLUDING THE SAME

(71) Applicant: IRISO ELECTRONICS CO., LTD., Kanagawa (JP)

(72) Inventors: Hiroaki Kobayashi, Kanagawa (JP); Takanori Abe, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/071,789

(22) Filed: Nov. 5, 2013

(65) Prior Publication Data

US 2014/0134890 A1 May 15, 2014

(30) Foreign Application Priority Data

Nov. 15, 2012 (JP) ..... 2012-251336

(51) Int. Cl.

| | |
|---|---|
| ***H01R 24/00*** | (2011.01) |
| ***H01R 13/11*** | (2006.01) |
| ***H01R 12/71*** | (2011.01) |
| *H01R 13/24* | (2006.01) |

(52) U.S. Cl.

CPC ..... *H01R 13/11* (2013.01); *H01R 13/2442* (2013.01); *H01R 13/2492* (2013.01); *H01R 12/712* (2013.01)

(58) Field of Classification Search

USPC ..... 439/637, 862, 248

See application file for complete search history.

(56) References Cited

U.S. PATENT DOCUMENTS

| | | | | |
|---|---|---|---|---|
| 3,289,146 | A | 11/1966 | Tuchel | |
| 4,087,151 | A | 5/1978 | Robert et al. | |
| 4,106,841 | A | 8/1978 | Vladic | |
| 5,310,357 | A * | 5/1994 | Olson | 439/346 |
| 6,764,345 | B1 | 7/2004 | Duesterhoeft et al. | |
| 2014/0134883 | A1 * | 5/2014 | Kobayashi et al. | 439/626 |

FOREIGN PATENT DOCUMENTS

| | | |
|---|---|---|
| JP | 39-20963 | 9/1939 |
| JP | 39-20963 A | 9/1939 |
| JP | 45-24200 A | 9/1970 |
| JP | 45-24200 U | 9/1970 |
| JP | 53-133790 | 11/1978 |

(Continued)

OTHER PUBLICATIONS

Office Action for Japanese Patent App. No. 2012-251336 (Feb. 12, 2013).

(Continued)

*Primary Examiner* — Phuong Dinh

(74) *Attorney, Agent, or Firm* — Cermak Nakajima & McGowan LLP; Tomoko Nakajima

(57) ABSTRACT

When a second junction portion of a terminal is pressed in the opposite direction of the direction of contact with a mating terminal, a first junction portion attempts to be displaced relatively in the direction of contact with the mating terminal as compared to the second junction portion while in a of state contact with the mating terminal, and accordingly, contact pressure of the first junction portion as to the mating terminal increases. Thus, after the mating terminal comes into contact with the first junction portion, contact pressure of the first junction portion as to the mating terminal is not reduced even when the mating terminal comes into contact with the second junction portion.

4 Claims, 12 Drawing Sheets

(56) References Cited

FOREIGN PATENT DOCUMENTS

| | | | |
|---|---|---|---|
| JP | 53-133790 | A | 11/1978 |
| JP | 2000-299150 | A | 10/2000 |
| JP | 2002-175847 | A | 6/2002 |
| JP | 2003-317843 | A | 11/2003 |
| WO | WO2011/059191 | A1 | 5/2011 |

OTHER PUBLICATIONS

Notice of Reasons for Rejection from Japanese Patent App. No. 2012-251336 (Feb. 12, 2013) with English language translation thereof.

Extended European Search Report for European Patent App. No. 13191372.5 (May 28, 2014).

* cited by examiner

ELECTRIC CONNECTION TERMINAL AND CONNECTOR INCLUDING THE SAME

BACKGROUND OF THE INVENTION

1. Field of the Invention

The present invention relates to an electric connection terminal for electrically connecting to a mating terminal used in a connector configured to connect boards for example, and a connector including the same.

2. Description of the Related Art

Heretofore, a type of connector which includes a connector main body, into which a connection portion of a mating connector is inserted, and a plurality of terminals mutually arrayed with at intervals in the width direction within the connector main body, has been known. Upon mating terminals being inserted into the connector main body, the terminals of the connector main body come into contact with the mating terminals while being elastically deformed in the direction orthogonal to the insertion direction of the object to be connected to (e.g., see Japanese Unexamined Patent Application Publication No. 2002-175847).

The terminals used for this connector include first and second contact portions mutually disposed in the insertion direction of the mating terminals with at intervals, a first elastic piece portion capable of elastic deformation in the direction of contact with the mating terminals where the first contact portion is provided, and a second elastic piece portion capable of elastic deformation in the direction of contact with the mating terminals where the second contact portion is provided. The first and second contact portions are configured to come into contact with the same position in the width direction of the mating terminals.

Specifically, upon the mating terminals being inserted to the terminals, the first contact portions come into contact with the mating terminals prior to the second contact portions of the terminals. Accordingly, even when foreign matter such as trash or dirt or the like adheres to the mating terminals, the foreign matter is removed by the first contact portions, so poor conduction between the second contact portions and the mating terminals can be prevented.

Incidentally, the terminals are each formed so that the first and second elastic piece portions obliquely extend toward the mating terminals from a terminal main body, and accordingly, when one of the first and second elastic piece portions is elastically deformed, the other elastic piece portion is displaced in the same direction. This has caused the following problem. After the first contact portion comes into contact with its mating terminal, the first elastic piece portion is also displaced in the same direction as with the second elastic piece portion when the second contact portion comes into contact with the mating terminal. Accordingly, contact pressure of the first contact portion as to the mating terminal is reduced, reducing the advantage of foreign matter removal by the first contact portion.

It has been found to be desirable to provide an electric connection terminal which prevents contact pressure of a first junction portion as to an object to be connected to, even when a mating terminal comes into contact with a second junction portion after the object to be connected to comes to into contact with the first junction portion. It has been found to be desirable to provide a connector including the same.

SUMMARY OF THE INVENTION

It has been found to be desirable to provide an electric connection terminal configured to come into contact with an object to be connected to by elastically being deformed in a direction orthogonal to an insertion direction of the object to be connected to. The electric connection terminal includes: a contact portion including first and second junction portions to come into contact with the object to be connected to, provided at intervals in the insertion direction of the object to be connected to, in which upon the object to be connected to being inserted, the first junction portion comes into contact with the object to be connected to prior to the second junction portion; a fixed portion configured to be fixed to an object to be attached to; an elastic piece portion formed between the contact portion and the fixed portion; a first fulcrum portion provided to the elastic piece portion at a position close to the fixed portion; and a second fulcrum portion provided to the elastic piece portion at a position close to the contact portion. The second junction portion is formed so that, upon the first junction portion being pressed in the opposite direction of a direction of contact with the object to be connected to, the second junction portion is displaced relatively in the direction of contact with the object to be connected to as compared to the first junction portion by the elastic piece portion being elastically deformed with the first fulcrum portion as a fulcrum. The first junction portion is formed so that, upon the second junction portion being pressed in the opposite direction of the direction of contact with the object to be connected to, the first junction portion is displaced relatively in the direction of contact with the object to be connected to as compared to the second junction portion by the elastic piece portion being elastically deformed with the second fulcrum portion as a fulcrum.

Thus, upon the object to be connected to coming into contact with the first junction portion, the second junction portion is displaced relatively in the direction of contact with the object to be connected to, as compared to the first junction portion by the elastic piece portion being elastically deformed in the opposite direction of the direction of contact with the object to be connected to, with the first fulcrum portion as a fulcrum. Accordingly, the second junction portion protrudes in the direction of contact with the object to be connected to as compared to the first junction portion, and the protrusion amount of the second junction portion for the object to be connected to coming into contact with the second junction portion is sufficiently secured. Next, upon the object to be connected to coming into contact with the second junction portion, the second junction portion is pressed while being in contact with the object to be connect by the elastic piece portion being elastically deformed in the opposite direction of the direction of contact with the object to be to, connected with the second fulcrum portion as a fulcrum. However, the first junction portion attempts to be displaced relatively in the direction of contact with the object to be connected to as compared to the second junction portion in a state in contact with the object to be connected to, and accordingly, contact pressure of the first junction portion as to the object to be connected to increases. Thus, after the object to be connected to comes into contact with the first junction portion, the contact pressure of the first junction portion as to the object to be connected to is not reduced even when the object to be connected to comes into contact with the second junction portion.

According to the present invention, after the object to be connected to comes into contact with the first junction portion, even when the object to be connected to comes into contact with the second junction portion, the contact pressure of the first junction portion as to the object to be connected to is not reduced. Accordingly, the advantages of removing foreign matter by the first junction portion can sufficiently be obtained.

DESCRIPTION OF THE PREFERRED EMBODIMENTS

First Embodiment

Figure 1:
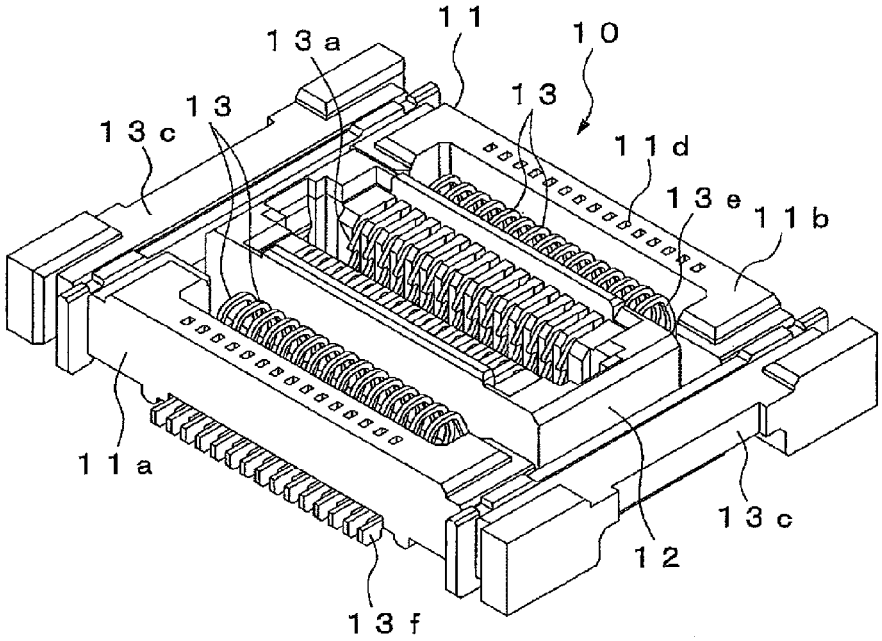
FIG. 1 is a perspective view illustrating a connector including electric connection terminals according to a first embodiment of the present invention.
Figure 2:
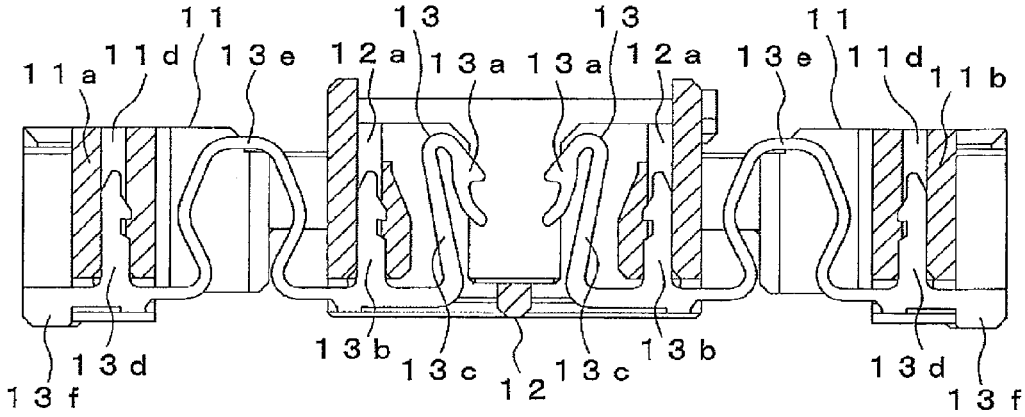
FIG. 2 is a side cross-sectional view of the connector.
Figure 3:
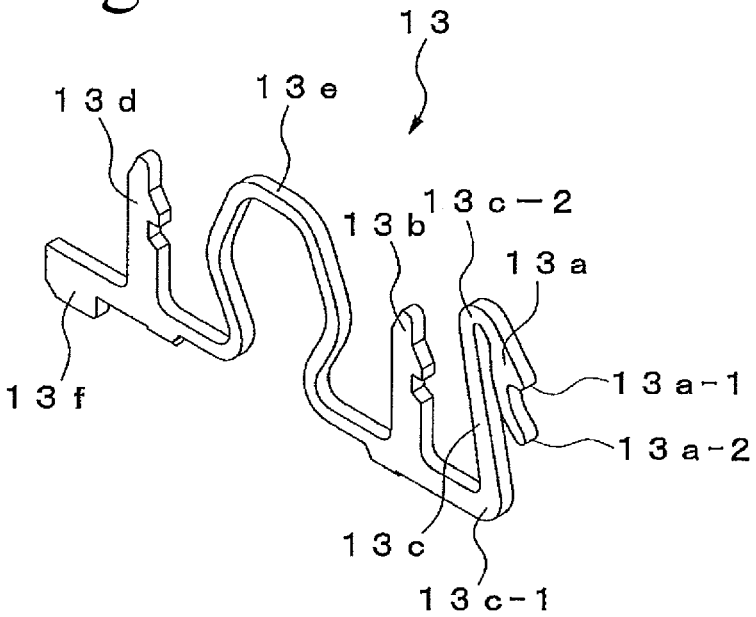
FIG. 3 is a perspective view of a terminal.

FIGS. 1 to 10 illustrate a connector used for connecting a pair of printed boards, for example, according to a first embodiment of the present invention. This connector 10 is fixed to a board not illustrated, and is used by being connected to a mating connector 20 fixed to another board.

The connector 10 is configured of a fixed housing 11 fixed to one of the boards (not illustrated), a movable housing 12 capable of moving against the fixed housing 11, and a plurality of terminals (electric connection terminals) 13 held at the fixed housing 11 and movable housing 12. The terminals 13 are arrayed at intervals from each other in the width direction of the connector, and also disposed in two rows back and front.

The fixed housing 11 is made of a synthetic resin molded article, and is formed in a generally rectangular parallelepiped shape having a smaller height dimension as compared to width and depth dimensions. The fixed housing 11 is configured of a front face portion 11*a*, a rear face portion 11*b*, and both side face portions 11*c*. The middle portion thereof is open both upward and downward. Also, a plurality of fixing holes 11*d* configured to fix the terminals 13 are provided to the front face portion 11*a* and rear face portion 11*b*.

The movable housing 12 is made of a synthetic resin molded article, and is formed in a generally rectangular parallelepiped shape having a smaller height dimension as compared to width and depth dimensions. The movable housing 12 is formed with a smaller outer shape as compared to the inner shape of the fixed housing 11, and is disposed movably in the front-to-back direction and width direction within the fixed housing 11. The movable housing 12 is formed with a hollow shape and the top face being opened. A plurality of fixing holes 12*a* configured to fix the terminals 13 are provided to the front face side and rear face side thereof.

The terminals 13 are made of an electroconductive metal, and terminals 13 on the front row side and terminals 13 on the rear row side are disposed in the front-to-back direction at intervals. The terminals 13 are configured of a contact portion 13*a* which comes into contact with a mating terminal serving as the object to be connected to, in the front-to-back direction (direction orthogonal to the insertion direction of the mating terminal), a first fixed piece portion 13*b* serving as a fixed portion to be fixed to the movable housing 12 serving as the object to be attached to, an elastic piece portion 13*c* formed between the contact portion 13*a* and the first fixed piece portion 13*b*, a second fixed piece portion 13*d* to be fixed to the fixed housing 11, a movable portion 13*e* formed in an elastically deformable manner between the first fixed piece portion 13*b* and the second fixed piece portion 13*d*, and a board connection portion 13*f* to be connected to a board. The terminals 13 on the front row side and the terminals 13 on the rear row side are disposed so that the contact portions 13*a* face each other.

A first junction portion 13*a*-1 and a second junction portion 13*a*-2 which come into contact with a terminal of the mating connector 20 are mutually provided to the contact portion 13*a* in the vertical direction (the insertion direction of the mating terminal) at intervals, and upon the mating terminal being inserted, the first junction portion 13*a*-1 comes into contact with the mating terminal prior to the second junction portion 13*a*-2. The contact portion 13*a* is formed with a forked shape, and the first and second junction portions 13*a*-1 and 13*a*-2 are provided to respective tip portions of the forks.

The first fixed piece portion 13*b* is formed so as to extend upward, and is fixed to the movable housing 12 by being pressed into a fixing hole portion 12*a* of the movable housing 12.

The elastic piece portion 13*c* is formed extending in the front-to-back direction from the lower edge side of the first fixed piece portion 13*b*, and also bending upward in a general L shape and extending farther in the vertical direction than the contact portion 13*a*, further bending downward in an inverted-U shape, and extending up to the upper edge of the contact portion 13*a*. The elastic piece portion 13*c* includes a first fulcrum portion 13*c*-1 provided closer to the first fixed piece portion 13*b* (a bending portion in a general L shape), and a second fulcrum portion 13*c*-2 provided closer to the contact portion 13*a* (a bending portion in an inverted-U shape), and is configured to be elastically deformed in the front-to-back direction with each of the supporting portions 13*c*-1 and 13*c*-2 as a fulcrum.

The second fixed piece portion 13*d* is formed so as to extend upward, and is fixed to the fixed housing 11 by being pressed into a fixing hole 11*d* of the fixed housing 11.

The movable portion 13*e* bends so as to make up a generally arched shape across from the lower edge of the first fixed piece portion 13*b* to the lower edge of the second fixed piece portion 13*d*, and is formed so as to be elastically deformed in the front-to-back direction, width direction, and vertical direction.

The board connection portion 13*f* is formed so as to extend toward the outer side in the front-to-back direction of the fixed housing 11 from the lower edge of the second fixed piece portion 13*d*, and a tip side thereof is configured to be soldered on a board.

Figure 4:
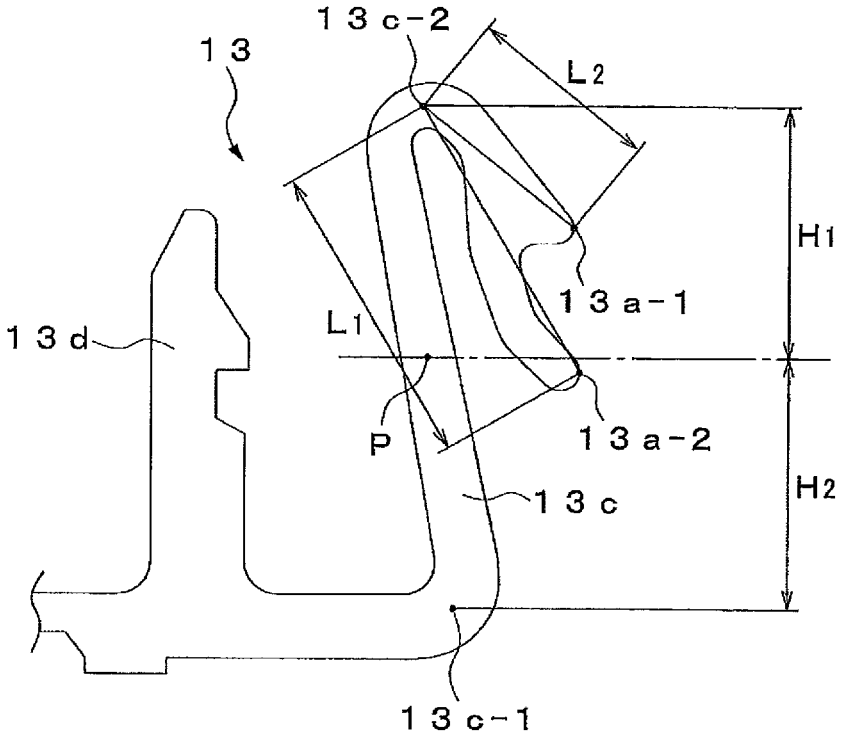
FIG. 4 is a side view of principal portions of the terminal.

The terminals 13 are configured so that the second fulcrum portion 13*c*-2, first junction portion 13*a*-1, second junction portion 13*a*-2, and first fulcrum portion 13*c*-1, are disposed in that order from above to below in the insertion direction of the mating terminal. In this case, as illustrated in FIG. 4, distance L1 from the second fulcrum portion 13*c*-2 to the second junction portion 13*a*-2 is longer than distance L2 from the second fulcrum portion 13*c*-2 to the first junction portion 13*a*-1. Also, the first junction portion 13*a*-1 is disposed higher than (second fulcrum portion 13*c*-2 side) an intermediate point P between the first and second fulcrum portions 13*c*-1 and 13*c*-2 in the insertion direction of the mating terminal. The second junction portion 13*a*-2 is disposed lower than (first fulcrum portion 13*c*-1 side) the intermediate point P. Note that the intermediate point P is a position where H1=H2 holds, where H1 represents the distance in the vertical down direction from the first fulcrum portion 13*c*-1 to the intermediate point P, and H2 represents the distance in the vertical direction from the second fulcrum portion 13*c*-2 to the intermediate point P.

Figure 7:
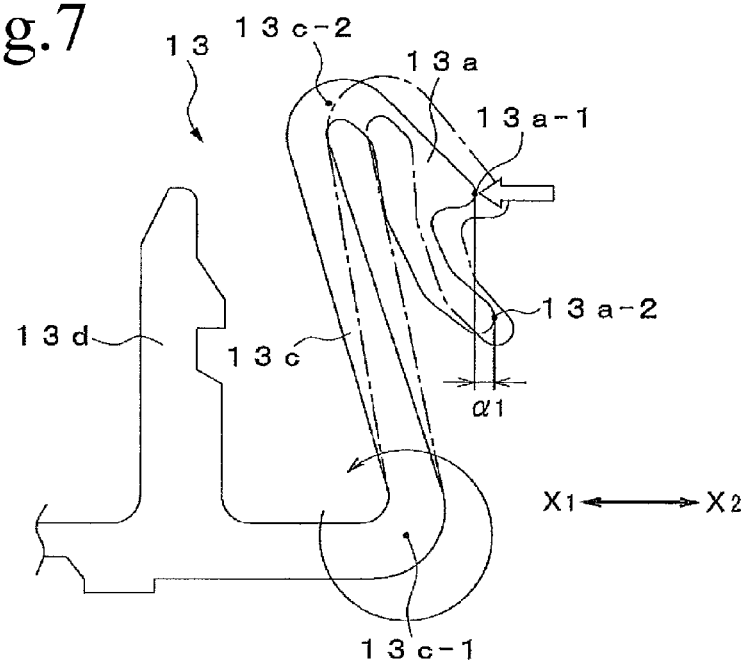
FIG. 7 is a diagram to describe operation of the terminal.
Figure 8:
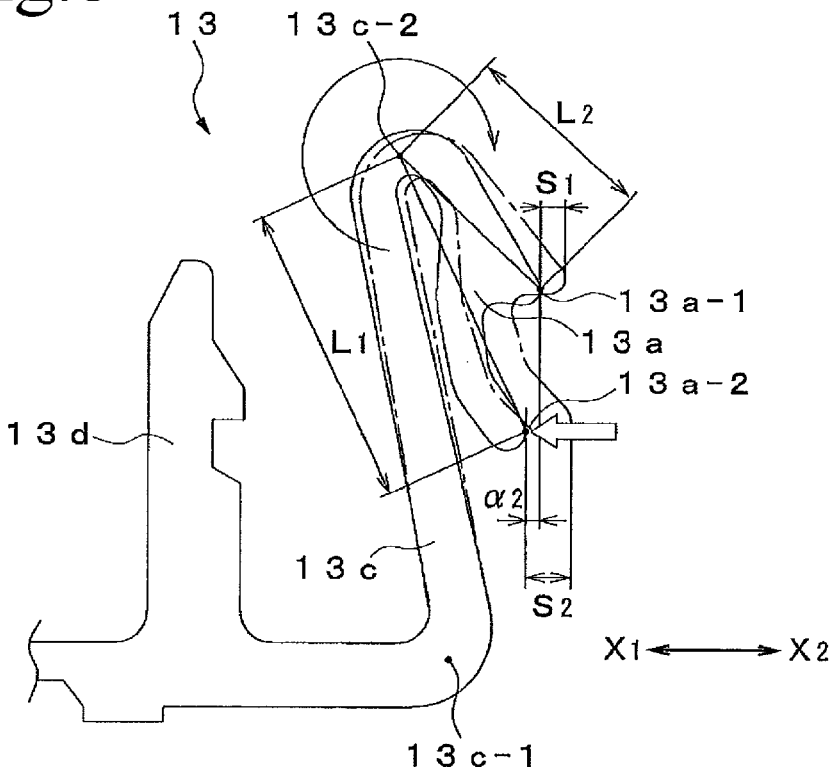
FIG. 8 is a diagram to describe operation of the terminal.

Thus, as illustrated in FIG. 7, upon the first junction portion 13*a*-1 being pressed in the opposite direction (X1 direction) of a direction of contact with the mating terminal, the elastic piece portion 13*c* is elastically deformed in an X1 direction with the first fulcrum portion 13*c*-1 as a fulcrum, whereby the contact portion 13*a* itself is displaced in the X1 direction, but the second junction portion 13*a*-2 of the contact portion 13*a* is displaced relatively in the direction of contact (X2 direction) with the mating terminal as compared to the first junction portion 13*a*-1, and protrudes in the X2 direction by $\alpha 1$. Also, as illustrated in FIG. 8, upon the second junction portion 13*a*-2 being pressed in the X1 direction, the elastic piece portion 13*c* is elastically deformed in the X1 direction with the second fulcrum portion 13*c*-2 as a fulcrum, whereby the contact portion 13*a* itself is displaced in the X1 direction, but the first junction portion 13*a*-1 of the contact portion 13*a* is displaced relatively in the direction of contact with the mating terminal as compared to the second junction portion 13*a*-2, and protrudes in the X2 direction by $\alpha 2$. At this time, the distance L1 from the second fulcrum portion 13*c*-2 to the second junction portion 13*a*-2 is longer than the distance L2 from the second fulcrum portion 13*c*-2 to the first junction portion 13*a*-1. Accordingly, the first and second junction portions 13*a*-1 and 13*a*-2 which are displaced with the same fulcrum (second fulcrum portion 13*c*-2) as the center, exhibit the following. The displacement amount S1 of the first junction portion 13*a*-1 decreases as compared to displacement amount S2 of the second junction portion 13*a*-2, the first junction portion 13*a*-1 is displaced relatively in the direction of contact with the mating terminal as compared to the second junction portion 13*a*-2 by difference $\alpha 2$ of the displacement amounts S1 and S2.

Also, the first junction portion 13*a*-1 is disposed closer to the second fulcrum portion 13*c*-2 side than the intermediate point P between the first and second fulcrum portions 13*c*-1 and 13*c*-2, and accordingly, distance from the first junction portion 13*a*-1 to the first fulcrum portion 13*c*-1 is longer than distance from the first junction portion 13*a*-1 to the second fulcrum portion 13*c*-2. Thus, when the first junction portion 13*a*-1 is pressed, the elastic piece portion 13*c* is readily elastically deformed with the first fulcrum portion 13*c*-1 as a fulcrum. On the other hand, the second junction portion 13*a*-2 is disposed closer to the first fulcrum portion 13*c*-1 side than the intermediate point P, and accordingly, distance from the second junction portion 13*a*-2 to the second fulcrum portion 13*c*-2 is longer than distance from the second junction portion 13*a*-2 to the first fulcrum portion 13*c*-1. Thus, when the second junction portion 13*a*-2 is pressed, the elastic piece portion 13*c* is readily elastically deformed with the second fulcrum portion 13*c*-2 as a fulcrum.

The mating connector 20 includes a housing 21 to be fitted to the connector 10, and a plurality of mating terminals 22 mutually held at intervals in the width direction in the housing 21, and a protruding portion 21*a* to be inserted between the terminals 13 to the back and front of the connector 10 is provided to the lower face of the housing 21.

The mating terminals 22 are mutually arrayed at intervals in the width direction of the connector, and also disposed in two rows back and front. The mating terminals 22 are configured of a contact portion 22*a* which comes into contact with a terminal 13 of the connector 10, and a board connection portion 22*b* to be connected to the other board (not illustrated), and terminals 22 on the front row side and terminals 22 on the rear row side are mutually disposed so that the contact portions 22*a* face in opposite directions, with a protruding portion 21*a* sandwiched therebetween. The contact portion 22*a* is formed so as to extend in the vertical direction along the protruding portion 21*a*, and is fixed to the protruding portion 21*a*. The board connection portion 22*b* is formed so as to extend toward the outer side in the front-to-back direction along the top face of the housing 21 from the upper edge of the contact portion 22*a*, and the tip side thereof is to be soldered to a board.

Figure 5:
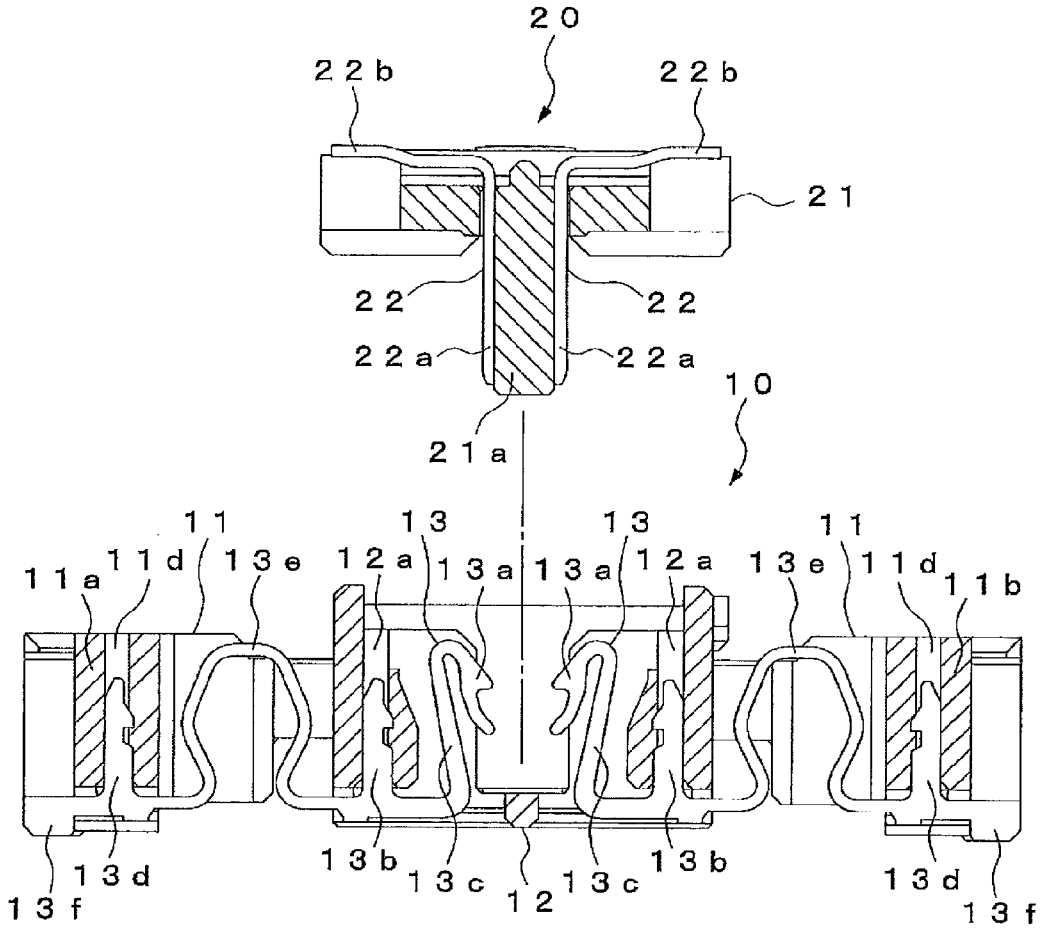
FIG. 5 is a side cross-sectional view illustrating a process of connecting to a mating connector.
Figure 6:
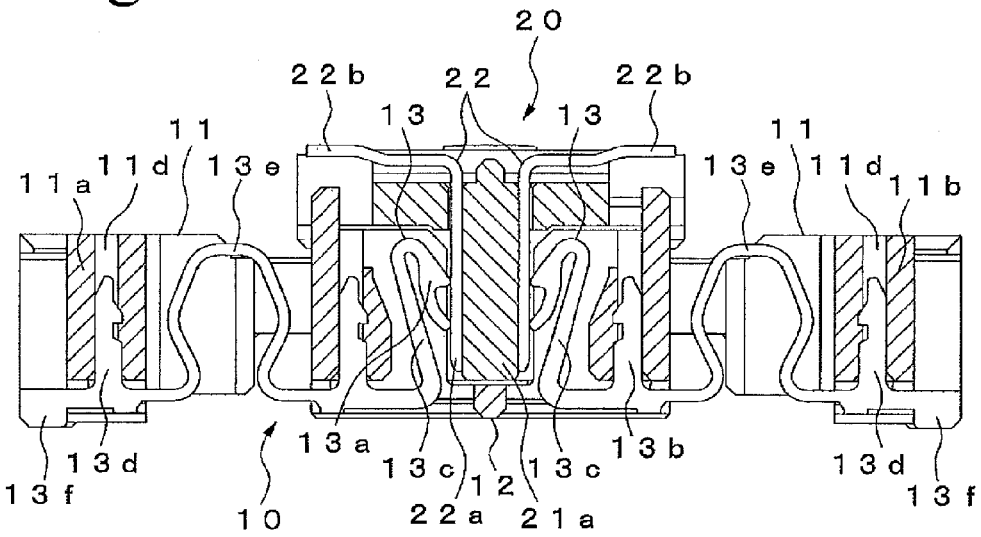
FIG. 6 is a side cross-sectional view illustrating a state of connection with the mating connector.

The connector 10 is configured such that the housing 21 of the mating connector 20 is fitted into the movable housing 12, as illustrated in FIG. 5. This results in a protruding portion 21*a* of the mating connector 20 being inserted between the contact portion 13*a* of the terminal 13 on the front row side and the contact portion 13*a* of the terminal 13 on the rear row side, as illustrated in FIG. 6. The terminals 13 of the connector 10 each come into contact with the mating terminals 22 of the mating connector 20, so that the connectors 10 and 20 are mutually connected.

At this time, the first and second junction portions 13*a*-1 and 13*a*-2 of a terminal 13 come into contact with the same position in the width direction of a mating terminal 22 in the insertion direction of the mating terminal 22 at intervals, and accordingly, the terminal 13 is in contact with the same mating terminal 22 at two points. Specifically, upon a mating terminal 22 being inserted into the movable housing 12, the first junction portion 13*a*-1 of a terminal 13 comes into contact with the contact portion 22*a* of the mating terminal 22 prior to the second junction portion 13*a*-2. Thus, even when foreign matter such as trash or dirt or the like adheres to the contact portion 22*a* of a mating terminal 22, the second junction portion 13*a*-2 comes into contact with the contact portion 22*a* of the mating terminal 22 after the foreign matter is removed by the first junction portion 13*a*-1 of the terminal 13, and accordingly, the second junction portion 13*a*-2 comes into contact with the mating terminal 22 in a sure manner, without poor conduction occurring due to the foreign matter.

Figure 9:
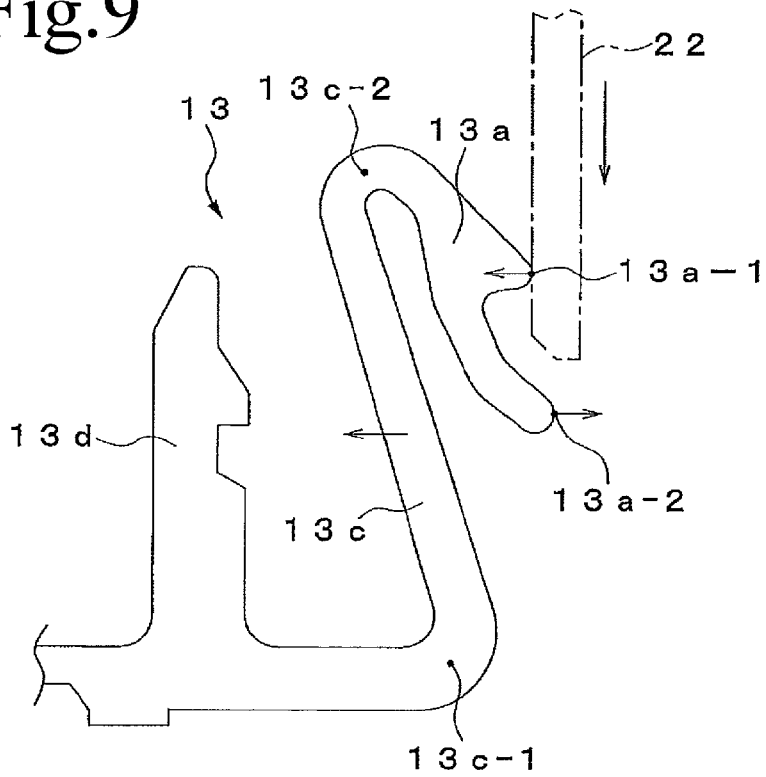
FIG. 9 is a diagram to describe operation of the terminal at the time of coming into contact with a mating terminal.

Also, as described above, upon the first junction portion 13*a*-1 of a terminal 13 of the connector 10 being pressed in the opposite direction of the direction of contact with a mating terminal 22, the second junction portion 13*a*-2 is displaced relatively in the direction of contact with the mating terminal 22 as compared to the first junction portion 13*a*-1. Accordingly, upon a mating terminal 22 coming into contact with the first junction portion 13*a*-1 of a terminal 13, the elastic piece portion 13*c* is elastically deformed in the opposite direction of the direction of contact with the mating terminal 22 with the first fulcrum portion 13*c*-1 as a fulcrum as illustrated in FIG. 9, so the second junction portion 13*a*-2 is displaced relatively in the direction of contact with the mating connector 20 as compared to the first junction portion 13*a*-1. Thus, the second junction portion 13*a*-2 protrudes in the X2 direction by α1 in FIG. 7 as to the first junction portion 13*a*-1. Accordingly, the protrusion amount of the second junction portion 13*a*-2 for the mating terminal 22 to come into contact with the second junction portion 13*a*-2 is sufficiently secured.

Figure 10:
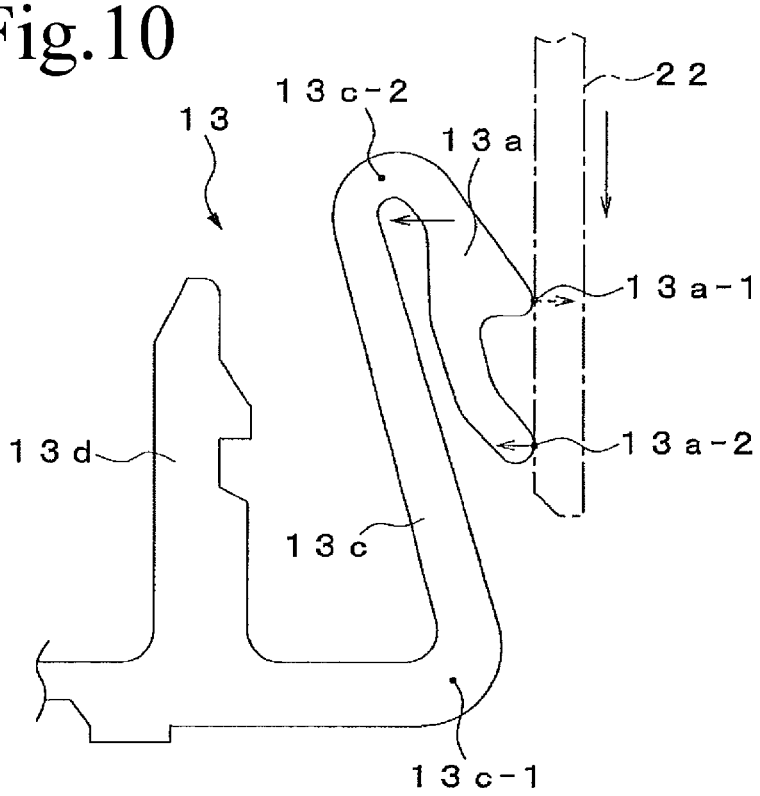
FIG. 10 is a diagram to describe operation of the terminal at the time of coming into contact with the mating terminal.
Figure 11:
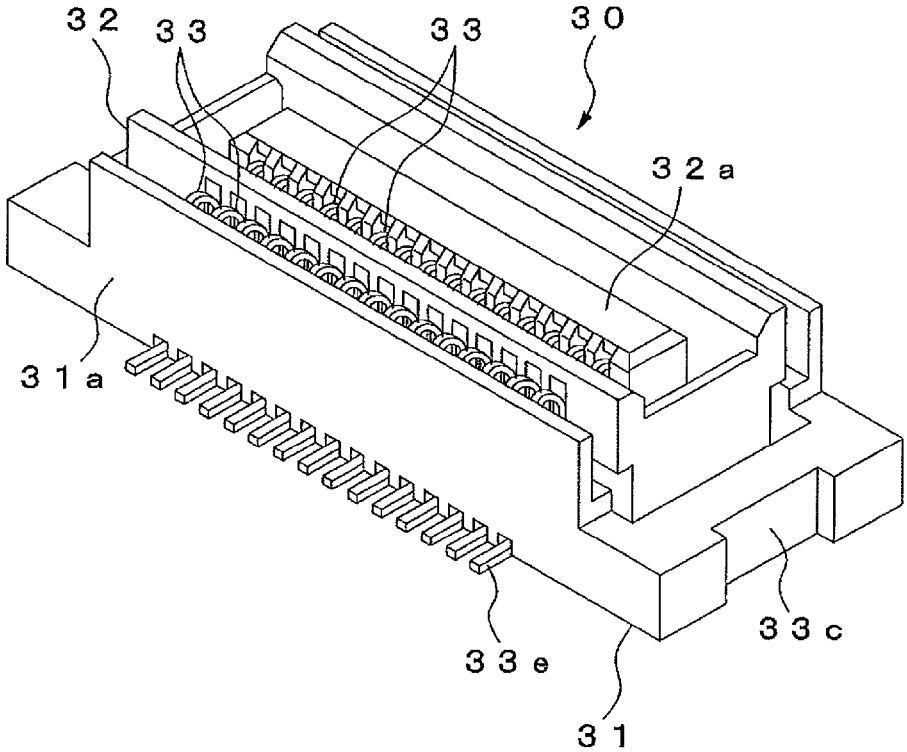
FIG. 11 is a perspective view illustrating a connector including electric connection terminals according to a second embodiment of the present invention.
Figure 12:
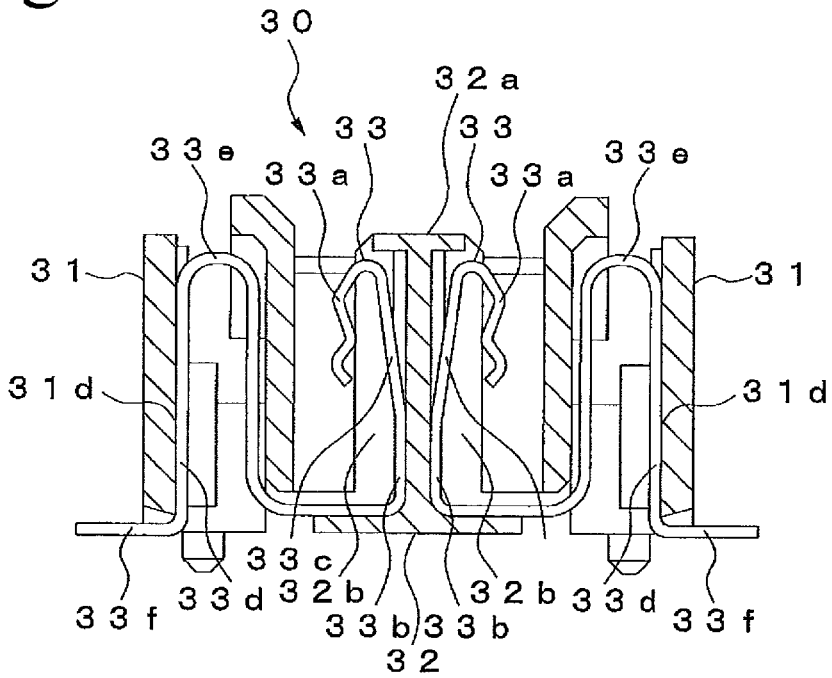
FIG. 12 is a side cross-sectional view of the connector.
Figure 13:
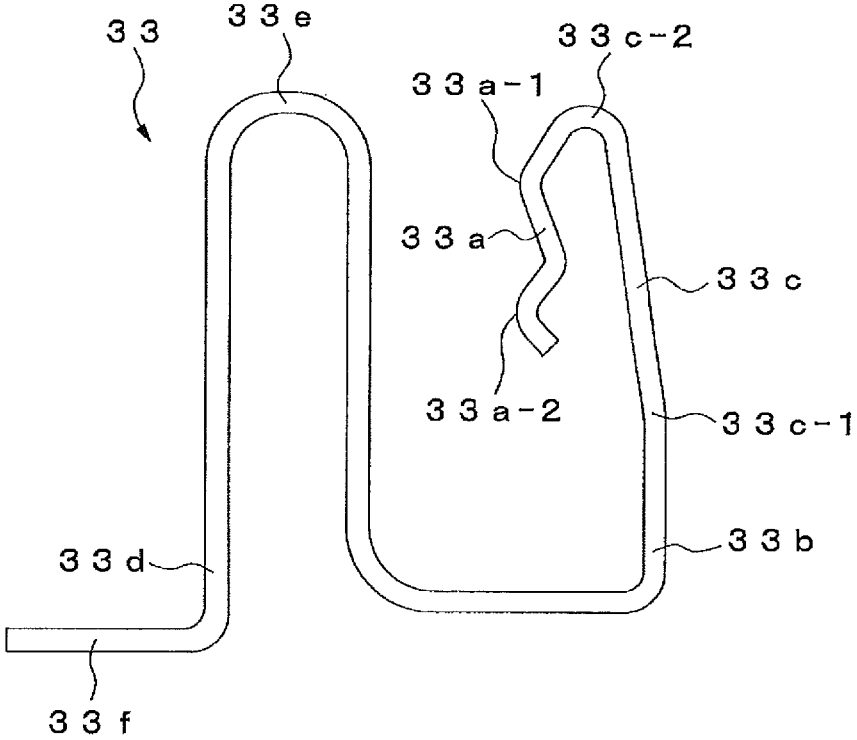
FIG. 13 is a side view of a terminal.

Next, upon a mating terminal 22 coming into contact with the second junction portion 13*a*-2 of a terminal 13, the elastic piece portion 13*c* is elastically deformed in the opposite direction of the direction of contact with the mating terminal 22 with the second fulcrum portion 13*c*-2 as a fulcrum, as illustrated in FIG. 10. The second junction portion 13*a*-2 thus is pressed while coming into contact with the mating terminal 22. At this time, as described above, upon the second junction portion 13*a*-2 of the terminal 13 being pressed in the opposite direction of the direction of contact with the mating terminal 22, as illustrated by a dashed arrow in FIG. 10, the first junction portion 13*a*-1 attempts to be displaced relatively in the direction of contact with the mating terminal 22 as compared to the second junction portion 13*a*-2 while in a of state contact with the mating terminal 22, and accordingly, contact pressure of the first junction portion 13*a*-1 as to the mating terminal 22 increases. Thus, after the mating terminal 22 comes into contact with the first junction portion 13*a*-1, contact pressure of the first junction portion 13*a*-1 as to the mating terminal 22 is not reduced even when the mating terminal 22 comes into contact with the second junction portion 13*a*-2.

Thus, according to the present embodiment, upon the first junction portion 13*a*-1 of a terminal 13 being pressed in the opposite direction of the direction of contact with a mating terminal 22, the elastic piece portion 13*c* is elastically deformed with the first fulcrum portion 13*c*-1 as a fulcrum, so the second junction portion 13*a*-2 of the terminal 13 is displaced relatively in the direction of contact with the mating terminal 22 as compared to the first junction portion 13*a*-1. Upon the second junction portion 13*a*-2 of the terminal 13 being pressed in the opposite direction of the direction of contact with the mating terminal 22, the elastic piece portion 13*c* is elastically deformed with the second fulcrum portion 13*c*-2 as a fulcrum, so the first junction portion 13*a*-1 is displaced relatively in the direction of contact with the mating terminal 22 as compared to the second junction portion 13*a*-2. Accordingly, the advantages of foreign matter removal by the first junction portion 13*a*-1 can sufficiently be obtained without decreasing the contact pressure of the first junction portion 13*a*-1 as to the mating terminal 22 after the mating terminal 22 comes into contact with the first junction portion 13*a*-1, even when the mating terminal 22 comes into contact with the second junction portion 13*a*-2.

Also, the second fulcrum portion 13*c*-2, first junction portion 13*a*-1, second junction portion 13*a*-2, and first fulcrum portion 13*c*-1 are sequentially disposed in the insertion direction of the mating terminal 22, and the distance L1 from the second fulcrum portion 13*c*-2 to the second junction portion 13*a*-2 is longer than the distance L2 from the second fulcrum portion 13*c*-2 to the first junction portion 13*a*-1. Accordingly, the first junction portion 13*a*-1 can relatively be displaced in the direction of contact with the mating terminal 22 in a sure manner as compared to the second junction portion 13*a*-2 by pressing the second junction portion 13*a*-2 in the opposite direction of the direction of contact with the mating terminal 22, which is extremely advantageous for improving the contact pressure of the first junction portion 13*a*-1 as to the mating terminal 22.

Further, the first junction portion 13*a*-1 is disposed closer to the second fulcrum portion 13*c*-2 side than the intermediate point P between the first and second fulcrum portions 13*c*-1 and 13*c*-2 in the insertion direction of the mating terminal 22. Also, the second junction portion 13*a*-2 is disposed closer to the first fulcrum portion 13*c*-1 side than the intermediate point P. Accordingly, when the first junction portion 13*a*-1 is pressed, the elastic piece portion 13*c* can readily elastically be deformed with the first fulcrum portion 13*c*-1 as a fulcrum, and when the second junction portion 13*a*-2 is pressed, the elastic piece portion 13*c* can readily elastically be deformed with the second fulcrum portion 13*c*-2 as a fulcrum, which is extremely advantageous for achieving the operation of the terminals 13.

Also, the contact portion 13*a* of a terminal 13 is formed in a forked shape having first and second junction portions 13*a*-1 and 13*a*-2 at tip portions respectively. Accordingly, the first and second junction portions 13*a*-1 and 13*a*-2 can be displaced in a mutually integral manner, which is extremely advantageous for achieving the operation of the terminals 13.

Second Embodiment

FIGS. 11 to 20 illustrate a connector used for connecting a pair of printed boards, for example, according to a second embodiment. This connector 30 is fixed to a board not illustrated, and is used by being connected to a mating connector 40 fixed to another board.

The connector 30 is configured of a fixed housing 31 fixed to one of the boards (not illustrated), a movable housing 32 capable of moving as to the fixed housing 31, and a plurality of terminals (electric connection terminals) 33 held at the fixed housing 31 and movable housing 32. The terminals 33 are mutually arrayed at intervals in the width direction of the connector, and also disposed in two rows back and front.

The fixed housing 31 is made of a synthetic resin molded article, and is formed in a generally rectangular parallelepiped shape having a smaller height dimension as compared to width and depth dimensions. The first fixed housing 31 is configured of a front face portion 31*a*, a rear face portion 31*b*, and both side face portions 31*c*. The middle portion thereof is open both upward and downward. Also, a plurality of fixing grooves 31*d* configured to fix the terminals 33 are provided to the front face portion 31*a* and rear face portion 31*b*.

The movable housing 32 is made of a synthetic resin molded article, and is formed in a generally rectangular parallelepiped shape having a smaller height dimension as compared to width and depth dimensions. The movable housing 32 is formed having a smaller outer shape as compared to the inner shape of the fixed housing 31, and is disposed movably in the front-to-back direction and width direction within the fixed housing 31. The movable housing 32 is formed having a hollow shape with the top face being opened, and a protruding portion 32*a* protruding upward from the middle portion in the front-to-back direction of the bottom is provided to the inner portion thereof. The protruding portion 32*a* is formed having a flat shape which is long in the width direction of the movable housing 32, and a plurality of terminal holes 32*b* which each hold the terminals 33 are provided to the front face and rear face thereof.

The terminals 33 are made of an electroconductive metal, and terminals 33 on the front row side and terminals 33 on the rear row side are disposed in the front-to-back direction at intervals. The terminals 33 are configured of a contact portion

33*a* which comes into contact with a mating terminal serving as an object to be connected to, in the front-to-back direction (direction orthogonal to the insertion direction of the mating terminal), a first fixed piece portion 33*b* serving as a fixed portion to be fixed to the movable housing 32 serving as an object to be attached to, an elastic piece portion 33*c* formed between the contact portion 33*a* and the first fixed piece portion 33*b*, a second fixed piece portion 33*d* to be fixed to the fixed housing 31, a movable portion 33*e* formed in an elastically deformable manner between the first fixed piece portion 33*b* and the second fixed piece portion 33*d*, and a board connection portion 33*f* to be connected to a board. The terminals 33 on the front row side and the terminals 33 on the rear row side are disposed so that the contact portions 33*a* thereof face opposite directions.

A first junction portion 33*a*-1 and a second junction portion 33*a*-2 which come into contact with a terminal of the mating connector 40 are mutually provided to the contact portion 33*a* in the vertical direction (the insertion direction of the mating terminal) at intervals. Upon the mating terminal being inserted, the first junction portion 33*a*-1 comes into contact with the mating terminal prior to the second junction portion 33*a*-2. The contact portion 33*a* is formed in a double chevron shape, and the first and second junction portions 33*a*-1 and 33*a*-2 are provided to the peak portions of the double chevron portions respectively.

The first fixed piece portion 33*b* is formed so as to extend upward, and is fixed to the movable housing 32 by being pressed into the lower edge side of a terminal hole 32*b* of the movable housing 32.

The elastic piece portion 33*c* is formed in a manner extending upward from the upper edge side of the first fixed piece portion 33*b*, and also bending so as to form a slope in the front-to-back direction, extending obliquely higher than the contact portion 33*a*, further bending downward in an inverted-U shape, and extending up to the upper edge of the contact portion 33*a*. The elastic piece portion 33*c* includes a first fulcrum portion 33*c*-1 provided closer to the first fixed piece portion 33*b* (a bending portion in a general L shape), and a second fulcrum portion 33*c*-2 provided closer to the contact portion 33*a* (a bending portion in an inverted-U shape), and is configured to be elastically deformed in the front-to-back direction with each of the supporting portions 33*c*-1 and 33*c*-2 as a fulcrum.

The second fixed piece portion 33*d* is formed so as to extend upward, and is fixed to the fixed housing 31 by being pressed into a fixing groove 31*d* of the fixed housing 31.

The movable portion 33*e* bends so as to make up an inverted-U shape across from the lower edge of the first fixed piece portion 33*b* to the lower edge of the second fixed piece portion 33*d*, and is formed so as to be elastically deformed in the front-to-back direction, width direction, and vertical direction.

The board connection portion 33*f* is formed so as to extend toward the outer side in the front-to-back direction of the fixed housing 31 from the lower edge of the second fixed piece portion 33*d*, and the tip side thereof is configured to be soldered to a board.

Figure 14:
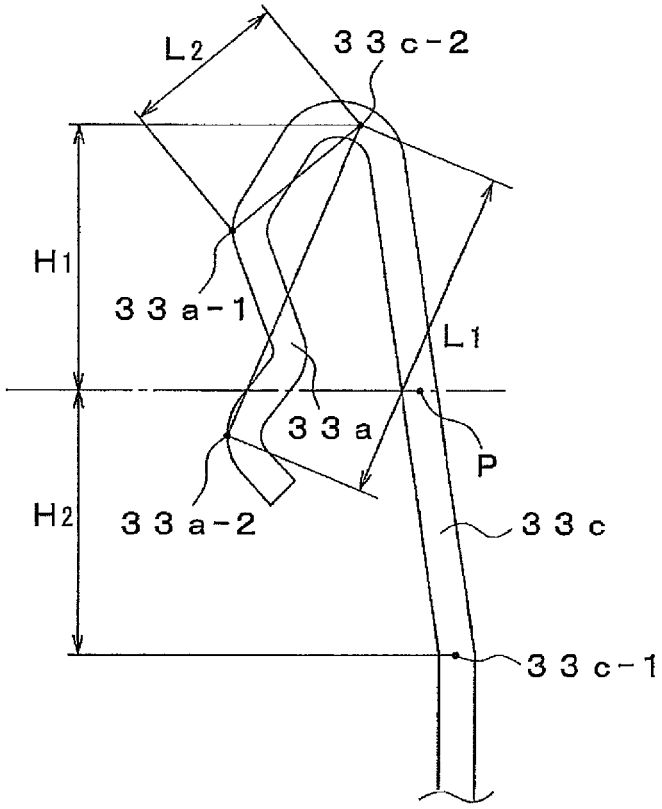
FIG. 14 is a side view of principal portions of the terminal.

The terminals 33 are configured so that the second fulcrum portion 33*c*-2, first junction portion 33*a*-1, second junction portion 33*a*-2, and first fulcrum portion 33*c*-1 are disposed in that order from above to below in the insertion direction of the mating terminal. In this case, as illustrated in FIG. 14, distance L1 from the second fulcrum portion 33*c*-2 to the second junction portion 33*a*-2 is longer than distance L2 from the second fulcrum portion 33*c*-2 to the first junction portion 33*a*-1. Also, the first junction portion 33*a*-1 is disposed higher than (second fulcrum portion 33*c*-2 side) an intermediate point P between the first and second fulcrum portions 33*c*-1 and 33*c*-2 in the insertion direction of the mating terminal, and the second junction portion 33*a*-2 is disposed lower than (first fulcrum portion 33*c*-1 side) the intermediate point P. Note that the intermediate point P is a position where H1=H2 holds, where H1 represents the distance in the vertical direction from the first fulcrum portion 33*c*-1 to the intermediate point P, and H2 represents the distance in the vertical direction from the second fulcrum portion 33*c*-2 to the intermediate point P.

Figure 17:
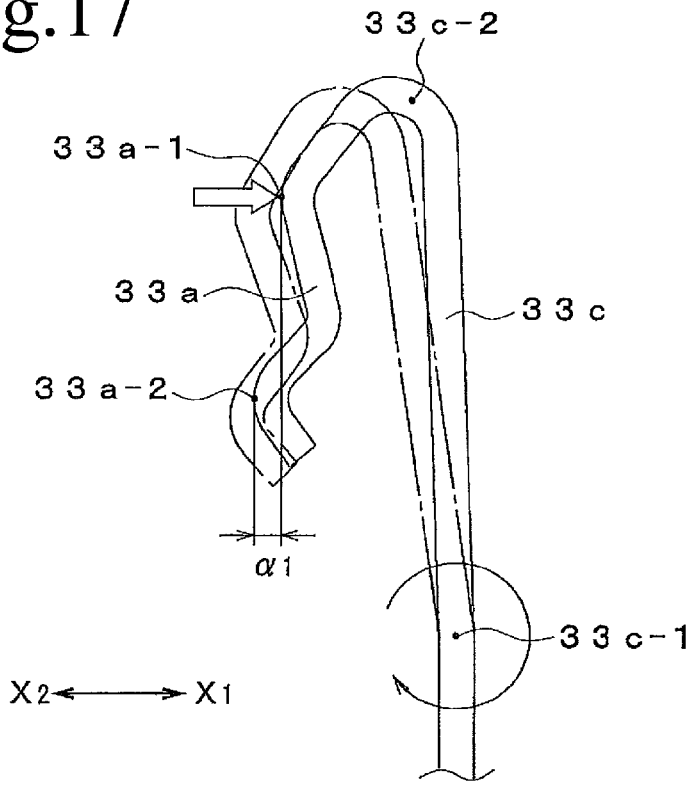
FIG. 17 is a diagram to describe operation of the terminal.
Figure 18:
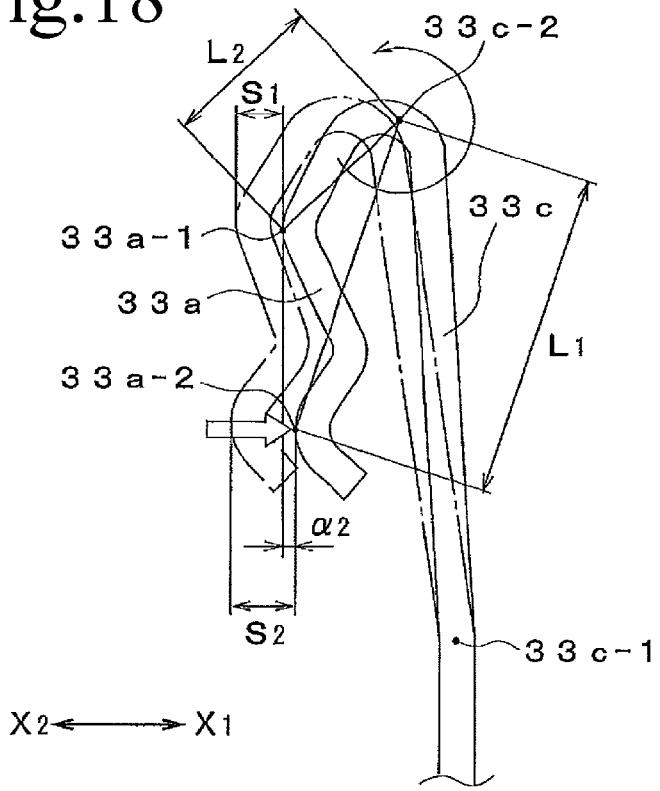
FIG. 18 is a diagram to describe operation of the terminal.

Thus, as illustrated in FIG. 17, upon the first junction portion 33*a*-1 being pressed in the opposite direction (X1 direction) of a direction of contact with the mating terminal, the elastic piece portion 33*c* is elastically deformed in an X1 direction with the first fulcrum portion 33*c*-1 as a fulcrum, whereby the contact portion 33*a* itself is displaced in the X1 direction, but the second junction portion 33*a*-2 of the contact portion 33*a* is displaced relatively in the direction of contact (X2 direction) with the mating terminal as compared to the first junction portion 33*a*-1, and protrudes in the X2 direction by $\alpha$1. Also, as illustrated in FIG. 18, upon the second junction portion 33*a*-2 being pressed in the X1 direction, the elastic piece portion 33*c* is elastically deformed in the X1 direction with the second fulcrum portion 33*c*-2 as a fulcrum, whereby the contact portion 33*a* itself is displaced in the X1 direction, but the first junction portion 33*a*-1 of the contact portion 33*a* is displaced relatively in the direction of contact with the mating terminal as compared to the second junction portion 33*a*-2, and protrudes in the X2 direction by $\alpha$2. At this time, the distance L1 from the second fulcrum portion 33*c*-2 to the second junction portion 33*a*-2 is longer than the distance L2 from the second fulcrum portion 33*c*-2 to the first junction portion 33*a*-1. Accordingly, the first and second junction portions 33*a*-1 and 33*a*-2 which are displaced with the same fulcrum (second fulcrum portion 33*c*-2) as the center, exhibit the following. The displacement amount S1 of the first junction portion 33*a*-1 decreases as compared to displacement amount S2 of the second junction portion 33*a*-2, the first junction portion 33*a*-1 is displaced relatively in the direction of contact with the mating terminal as compared to the second junction portion 33*a*-2 by difference $\alpha$2 of the displacement amounts S1 and S2.

Also, the first junction portion 33*a*-1 is disposed closer to the second fulcrum portion 33*c*-2 side than the intermediate point P between the first and second fulcrum portions 33*c*-1 and 33*c*-2, and accordingly, distance from the first junction portion 33*a*-1 to the first fulcrum portion 33*c*-1 is longer than distance from the first junction portion 33*a*-1 to the second fulcrum portion 33*c*-2. Thus, when the first junction portion 33*a*-1 is pressed, the elastic piece portion 33*c* is readily elastically deformed with the first fulcrum portion 33*c*-1 as a fulcrum. On the other hand, the second junction portion 33*a*-2 is disposed closer to the first fulcrum portion 33*c*-1 side than the intermediate point P, and accordingly, distance from the second junction portion 33*a*-2 to the second fulcrum portion 33*c*-2 is longer than distance from the second junction portion 33*a*-2 to the first fulcrum portion 33*c*-1, and upon the second junction portion 33*a*-2 being pressed, the elastic piece portion 33*c* is readily elastically deformed with the second fulcrum portion 33*c*-2 as a fulcrum.

The mating connector 40 includes a housing 41 to be fitted to the connector 30, and a plurality of mating terminals 42 mutually held at intervals in the width direction in the housing 41, and a recessed portion 41*a* into which each of the terminals 33 of the connector 30 is inserted is provided to the lower face of the housing 41.

The mating terminals 42 are mutually arrayed at intervals in the width direction of the connector, and also disposed in two rows back and front. The mating terminals 42 are configured of a contact portion 42*a* which comes into contact with a terminal 33 of the connector 30, a fixed piece portion 42*b* to be fixed to the housing 41, and a board connection portion 42*c* to be connected to the other board (not illustrated), and terminals 42 on the front row side and terminals 42 on the rear row side are mutually disposed so that the contact portions 42*a* face each other at intervals. The contact portion 42*a* is formed so as to extend in the vertical direction along the inner face of the recessed portion 41*a*. Also, the fixed piece portion 42*b* is fixed to the housing 41 by being pressed into a fixing hole 41*b* provided to the housing 41. The board connection portion 42*c* is formed so as to extend toward the outer side in the front-to-back direction along the top face of the housing 41 from the upper edge of the contact portion 42*a*, and the tip side thereof is to be soldered to a board.

Figure 15:
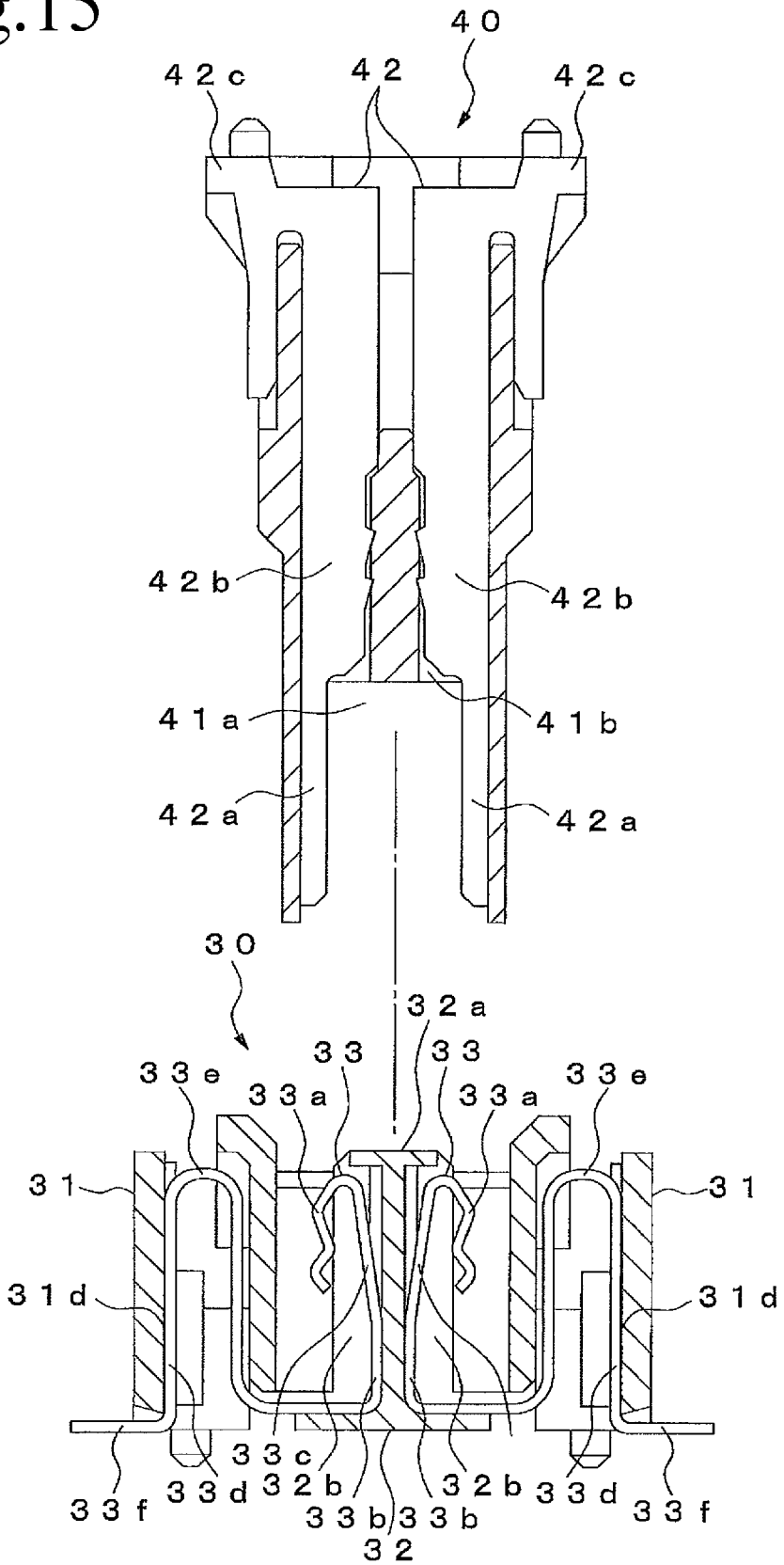
FIG. 15 is a side cross-sectional view illustrating a process of connecting to a mating connector.
Figure 16:
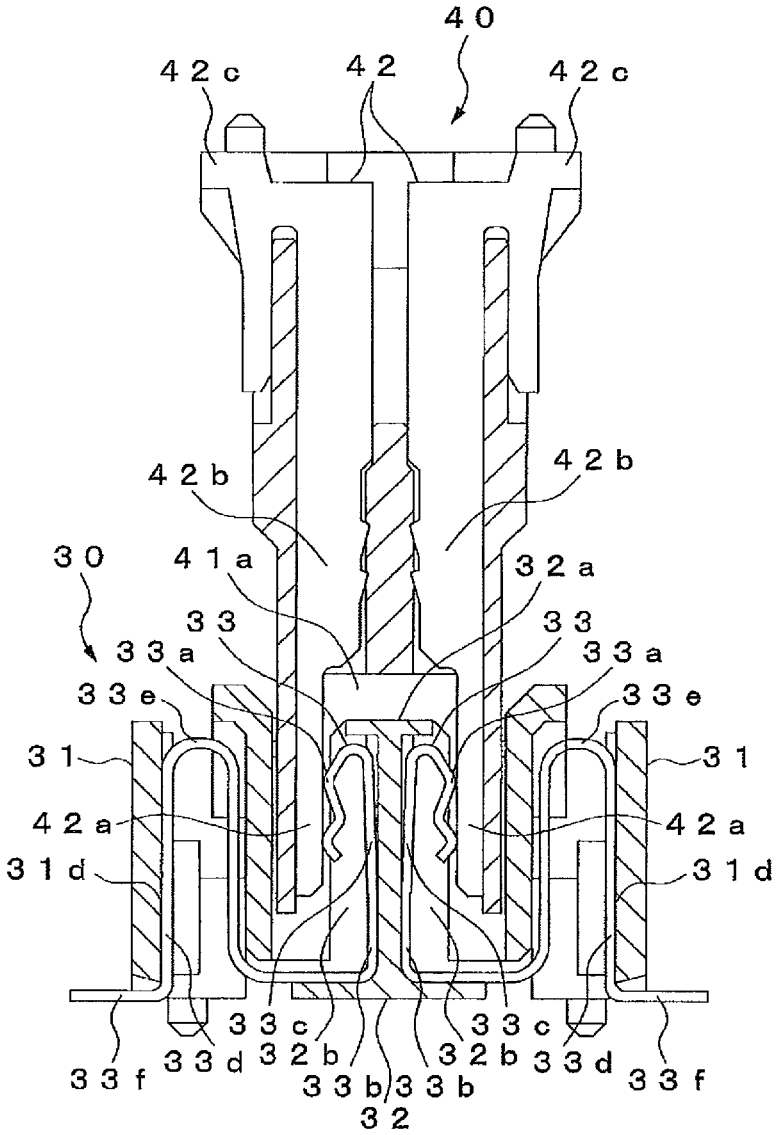
FIG. 16 is a side cross-sectional view illustrating a state of connection with the mating connector.

The connector 30 is configured such that the housing 41 of the mating connector 40 is fitted into the movable housing 32, as illustrated in FIG. 15. This results in the contact portion 33*a* of a the terminal 33 on the front row side and the contact portion 33*a* of a terminal 33 on the rear row side being inserted into a recessed portion 41*a* of the mating connector 40, as illustrated in FIG. 16. The terminals 33 of the connector 30 come into contact with the mating terminals 42 of the mating connector 40 respectively, and the connectors 30 and 40 are mutually connected.

At this time, the first and second junction portions 33*a*-1 and 33*a*-2 of a terminal 33 come into contact with the same position in the width direction of a mating terminal 42 in the insertion direction of the mating terminal 42 at intervals, and accordingly, the terminal 33 is in contact with the same mating terminal 42 at two pints. Specifically, upon a mating terminal 42 being inserted into the movable housing 32, the first junction portion 33*a*-1 of a terminal 33 comes into contact with the contact portion 42*a* of the mating terminal 42 prior to the second junction portion 33*a*-2. Thus, even when foreign matter such as trash or dirt or the like adheres to the contact portion 42*a* of a mating terminal 42, the second junction portion 33*a*-2 comes into contact with the contact portion 42*a* of the mating terminal 42 after the foreign matter is removed by the first junction portion 33*a*-1 of the terminal 33, and accordingly, the second junction portion 33*a*-2 comes into contact with the mating terminal 42 in a sure manner without poor conduction occurring due to foreign matter.

Figure 19:
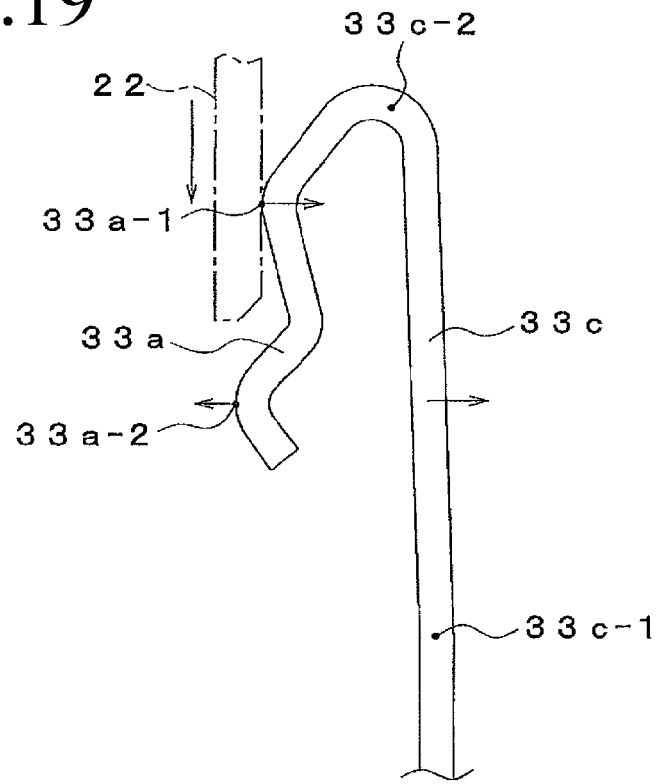
FIG. 19 is a diagram to describe operation of the terminal at the time of coming into contact with a mating terminal.

Also, as described above, when the first junction portion 33*a*-1 of a terminal 33 of the connector 30 is pressed in the opposite direction of the direction of contact with a mating terminal 42, the second junction portion 33*a*-2 is displaced relatively in the direction of contact with the mating terminal 42 as compared to the first junction portion 33*a*-1. Accordingly, upon a mating terminal 42 coming into contact with the first junction portion 33*a*-1 of a terminal 33, the elastic piece portion 33*c* is elastically deformed in the opposite direction of the direction of contact with the mating terminal 42 with the first fulcrum portion 33*c*-1 as a fulcrum, as illustrated in FIG. 19. Thus, the second junction portion 33*a*-2 is displaced relatively in the direction of contact with the mating connector 40 as compared to the first junction portion 33*a*-1. Thus, the second junction portion 33*a*-2 protrudes in the X2 direction by $\alpha 1$ in FIG. 17 as to the first junction portion 33*a*-1, and accordingly, protrusion amount of the second junction portion 33*a*-2 for the mating terminal 42 to come into contact with the second junction portion 33*a*-2 is sufficiently secured.

Figure 20:
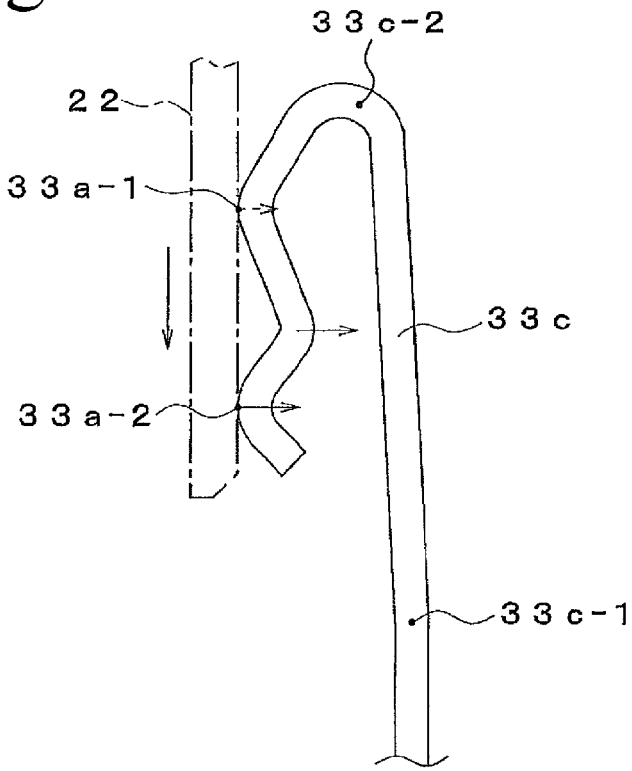
FIG. 20 is a diagram to describe operation of the terminal at the time of coming into contact with the mating terminal.

Next, as illustrated in FIG. 20, upon a mating terminal 42 coming into contact with the second junction portion 33*a*-2 of a terminal 33, the elastic piece portion 33*c* is elastically deformed in the opposite direction of the direction of contact with the mating terminal 42, with the second fulcrum portion 33*c*-2 as a fulcrum. Accordingly, the second junction portion 33*a*-2 is pressed while coming into contact with the mating terminal 42. At this time, as described above, upon the second junction portion 33*a*-2 of the terminal 33 being pressed in the opposite direction of the direction of contact with the mating terminal 42, as illustrated by a dashed arrow in FIG. 20, the first junction portion 33*a*-1 attempts to be displaced relatively in the direction of contact with the mating terminal 42 as compared to the second junction portion 33*a*-2 while in a state of contact with the mating terminal 42. Accordingly, contact pressure of the first junction portion 33*a*-1 as to the mating terminal 42 increases. Thus, after the mating terminal 42 comes into contact with the first junction portion 33*a*-1, contact pressure of the first junction portion 33*a*-1 as to the mating terminal 42 is not reduced even when the mating terminal 42 comes into contact with the second junction portion 33*a*-2.

Thus, according to the present embodiment, upon the first junction portion 33*a*-1 of a terminal 33 being pressed in the opposite direction of the direction of contact with a mating terminal 42, the elastic piece portion 33*c* is elastically deformed with the first fulcrum portion 33*c*-1 as a fulcrum, so the second junction portion 33*a*-2 of the terminal 33 is displaced relatively in the direction of contact with the mating terminal 42 as compared to the first junction portion 33*a*-1. Upon the second junction portion 33*a*-2 of the terminal 33 being pressed in the opposite direction of the direction of contact with the mating terminal 42, the elastic piece portion 33*c* is elastically deformed with the second fulcrum portion 33*c*-2 as a fulcrum, so the first junction portion 33*a*-1 is displaced relatively in the direction of contact with the mating terminal 42 as compared to the second junction portion 33*a*-2. Accordingly, the advantages of foreign matter removal by the first junction portion 33*a*-1 can sufficiently be obtained without decreasing the contact pressure of the first junction portion 33*a*-1 as to the mating terminal 42 after the mating terminal 42 comes into contact with the first junction portion 33*a*-1, even when the mating terminal 42 comes into contact with the second junction portion 33*a*-2.

Also, the second fulcrum portion 33*c*-2, first junction portion 33*a*-1, second junction portion 33*a*-2, and first fulcrum portion 33*c*-1 are sequentially disposed in the insertion direction of the mating terminal 42, and the distance L1 from the second fulcrum portion 33*c*-2 to the second junction portion 33*a*-2 is longer than the distance L2 from the second fulcrum portion 33*c*-2 to the first junction portion 33*a*-1. Accordingly, the first junction portion 33*a*-1 can relatively be displaced in the direction of contact with the mating terminal 42 in a sure manner as compared to the second junction portion 33*a*-2 by pressing the second junction portion 33*a*-2 in the opposite direction of the direction of contact with the mating terminal 42, which is extremely advantageous for improving the contact pressure of the first junction portion 33*a*-1 as to the mating terminal 42.

Further, the first junction portion 33*a*-1 is disposed closer to the second fulcrum portion 33*c*-2 side than the intermediate point P between the first and second fulcrum portions 33*c*-1 and 33*c*-2 in the insertion direction of the mating terminal 42. Also, the second junction portion 33*a*-2 is disposed closer to the first fulcrum portion 33*c*-1 side than the intermediate point P. Accordingly, at the time of the first junction portion 33*a*-1 being pressed, the elastic piece portion 33*c* can readily elastically be deformed with the first fulcrum portion 33*c*-1 as a fulcrum, and at the time of the second junction portion 33*a*-2 being pressed, the elastic piece portion 33*c* can readily elastically be deformed with the second fulcrum portion 33*c*-2 as a fulcrum, which is extremely advantageous for achieving the operation of the terminals 33.

Also, the contact portion 33*a* of a terminal 33 is formed in a double chevron shape having first and second junction portions 33*a*-1 and 33*b*-1 at tip portions respectively, and accordingly, the first and second junction portions 33*a*-1 and 33*b*-1 can mutually integrally be displaced, which is extremely advantageous for achieving the operation of the terminals 33.

Note that though the above embodiments illustrate that the first fixed piece portions 13*b* and 33*b* serving as fixed portions are fixed to the fixed housings 11 and 31 serving as objects to be attached, terminals may directly be fixed to a board serving as an object to be attached to, by the terminals themselves being soldered on the board, without using connectors.

What is claimed is:

1. An electric connection terminal configured to come into contact with an object to be connected to, by being elastically deformed in a direction orthogonal to an insertion direction of the object to be connected to, the electric connection terminal comprising:

a contact portion formed in a forked shape and including first and second junction portions, each at tip portions, to come into contact with the object to be connected to, provided at intervals in the insertion direction of the object to be connected to, in which upon the object to be connected to being inserted, the first junction portion comes into contact with the object to be connected to prior to the second junction portion;

a fixed portion configured to be fixed to an object to be attached to;

an elastic piece portion formed between the contact portion and the fixed portion;

a first fulcrum portion provided to the elastic piece portion at a position close to the fixed portion; and a second fulcrum portion provided to the elastic piece portion at a position close to the contact portion, wherein the second fulcrum portion, the first junction portion, the second junction portion, and the first fulcrum portion are disposed in that order in the insertion direction of the object to be connected to, wherein the second fulcrum portion, the first junction portion, the second junction portion, and the first fulcrum portion are formed so that distance from the second fulcrum portion to the second junction portion is longer than distance from the second fulcrum portion to the first junction portion, wherein the first junction portion is disposed closer to the second fulcrum portion side than an intermediate point between the first and second fulcrum portions in the insertion direction of the object to be connected to, and the second junction portion is disposed closer to the first fulcrum portion side than the intermediate point, wherein the second fulcrum portion is disposed at a position that is farther from the object to be connected to than the first fulcrum portion in the direction orthogonal to the insertion direction of the object to be connected to, and wherein the second junction portion is formed so that, upon the first junction portion being pressed in the opposite direction of a direction of contact with the object to be connected to, the second junction portion is displaced relatively in the direction of contact with the object to be connected to as compared to the first junction portion by the elastic piece portion being elastically deformed with the first fulcrum portion as a fulcrum, and the first junction portion is formed so that, upon the second junction portion being pressed in the opposite direction of the direction of contact with the object to be connected to, the first junction portion is displaced relatively in the direction of contact with the object to be connected to as compared to the second junction portion by the elastic piece portion being elastically deformed with the second fulcrum portion as a fulcrum.

2. The electric connection terminal according to claim 1, wherein the elastic piece portion is formed so as to extend obliquely from the first fulcrum portion toward the second fulcrum portion in a direction away from the object to be connected to.

3. A connector comprising:

the electric connection terminal according to claim 1.

4. A connector comprising:

the electric connection terminal according to claim 2.

* * * * *